US006036392A

United States Patent [19]

Er

[11] Patent Number: 6,036,392

[45] Date of Patent: Mar. 14, 2000

[54] PAINTING TOOL

[76] Inventor: Poh Leong Er, Blk 2, No. 449 Lorong 3, Geylang Singapore 388920, Singapore

[21] Appl. No.: 09/091,380

[22] PCT Filed: Feb. 4, 1997

[86] PCT No.: PCT/SG97/00004

§ 371 Date: Jun. 17, 1998

§ 102(e) Date: Jun. 17, 1998

[87] PCT Pub. No.: WO97/28904

PCT Pub. Date: Aug. 14, 1997

[30] Foreign Application Priority Data

Feb. 10, 1996 [SG] Singapore ..... 9611922-7

[51] Int. Cl.[7] ..... B05C 1/00

[52] U.S. Cl. ..... 401/197; 401/196

[58] Field of Search ..... 401/197, 196, 401/203, 204, 205, 207

[56] References Cited

U.S. PATENT DOCUMENTS

| | | | |
|---|---|---|---|
| 2,698,451 | 1/1955 | Wonso | 401/197 |
| 2,849,157 | 8/1958 | Remien, Jr. | 401/197 X |
| 2,927,334 | 3/1960 | Wonso | 401/197 |
| 3,099,034 | 7/1963 | Leland | 401/197 |
| 3,336,625 | 8/1967 | Carlee | 401/197 |
| 3,588,264 | 6/1971 | Mallindine | 401/197 X |
| 3,937,583 | 2/1976 | Tyson et al. | 401/197 |
| 4,808,438 | 2/1989 | Rozenshtein | 401/197 X |

FOREIGN PATENT DOCUMENTS

| | | | |
|---|---|---|---|
| 2596297 | 10/1987 | France | 401/197 |

*Primary Examiner*—David J. Walczak

*Attorney, Agent, or Firm*—Lawrence Y.D. Ho; David D. Chung; Jacqueline C.T. Lui

[57] ABSTRACT

A paint roller with an internal reservoir for receiving and dispensing paint. The interior of the cylindrical roller communicates with the external surface via a plurality of slits running substantially normal to the longitudinal axis of the shell. An applicator is laid over the external surface of the shell. Paint of the internal reservoir is dispensed evenly and automatically over the slits.

15 Claims, 4 Drawing Sheets

PAINTING TOOL

FIELD OF THE INVENTION

The present invention relates to apparatus for applying fluids over surfaces. In particular, the present invention is a tool for storing and applying paint.

BACKGROUND OF THE INVENTION

Paint brush and paint roller are well known tool for applying paint over surfaces of building and walls. For painting large surfaces, paint roller and pan remain the instruments of choice for painting professionals and do-it-yourself individuals because they are inexpensive and apply paint consistently. However, the need to replenish the roller frequently attracts a number of new proposals and invention.

In general, the prior art teaches the combination of internal paint reservoirs and either a single or plurality of rollers. See, for example, U.S. Pat. Nos. 3,905,295; 4,167,349; and the list of patents disclosed in U.S. Pat. No. 4,555,195. These prior art painting tools having internal paint reservoirs and roller(s) have a common feature: paint from the reservoirs is applied over the external surface of the roller before the paint is introduced to the target surface.

The absence of these prior art paint tools from the market may be attributed to the fact that these alternatives are expensive, difficulty to maintain, and cumbersome to use. The higher expected cost is related to the large number of auxiliary rollers besides the main roller. Moreover, the complicated structure and movement of painting tool such as U.S. Pat. Nos. 3,905,295 and 4,555,195 suggest that it can be used at most once as coagulated paint clogs the intermediate rollers. Finally, the prior art paint reservoirs are disposed quite a distance off the longitudinal axis of the main rollers. As the reservoir when filled with paint is heavier, the center of gravity of the prior art paint rollers is away from the longitudinal axis of the roller. It follows that the user will find these prior art paint rollers less maneuverable than the regular paint roller.

OBJECT OF THE INVENTION

It is an object of the present invention to reduce the number of components in paint tool without compromising the convenience and maintenance of prior art paint roller.

It is a further object of the present invention to incorporate an internal reservoir to a paint roller for dispensing paint conveniently without the need to interrupt the user's task of painting.

It is yet another object of the present invention to reduce the distance between the internal reservoir with the longitudinal axis of the roller such that the user can enhance the maneuverability and feel of applying the roller on target surface.

SUMMARY OF THE INVENTION

The present invention is a paint roller incorporating an internal reservoir disposed within the interior space of the roller for receiving and dispensing paint. The interior of the roller communicates with the external surface of the roller over a plurality of slits in the roller. An applicator is laid over the external surface of the roller. Paint from the internal reservoir is dispensed evenly and automatically over the slits and the applicators to the target surface. Disposed within the internal reservoir of the roller is a wall for storing residue paint when the roller is rested in a vertical or quasi-vertical position. The center of gravity of the reservoir according to the embodiments shown is close to the longitudinal axis of the roller, such that the user can apply paint to the target surface with maximum maneuverability and real feel of a paint roller.

BRIEF DESCRIPTION OF THE DRAWINGS

FIG. 6 is a cross-sectional view taken along the section B—B as shown in FIG. 4.

DESCRIPTION OF THE EMBODIMENT OF THE INVENTION

Figure 1:
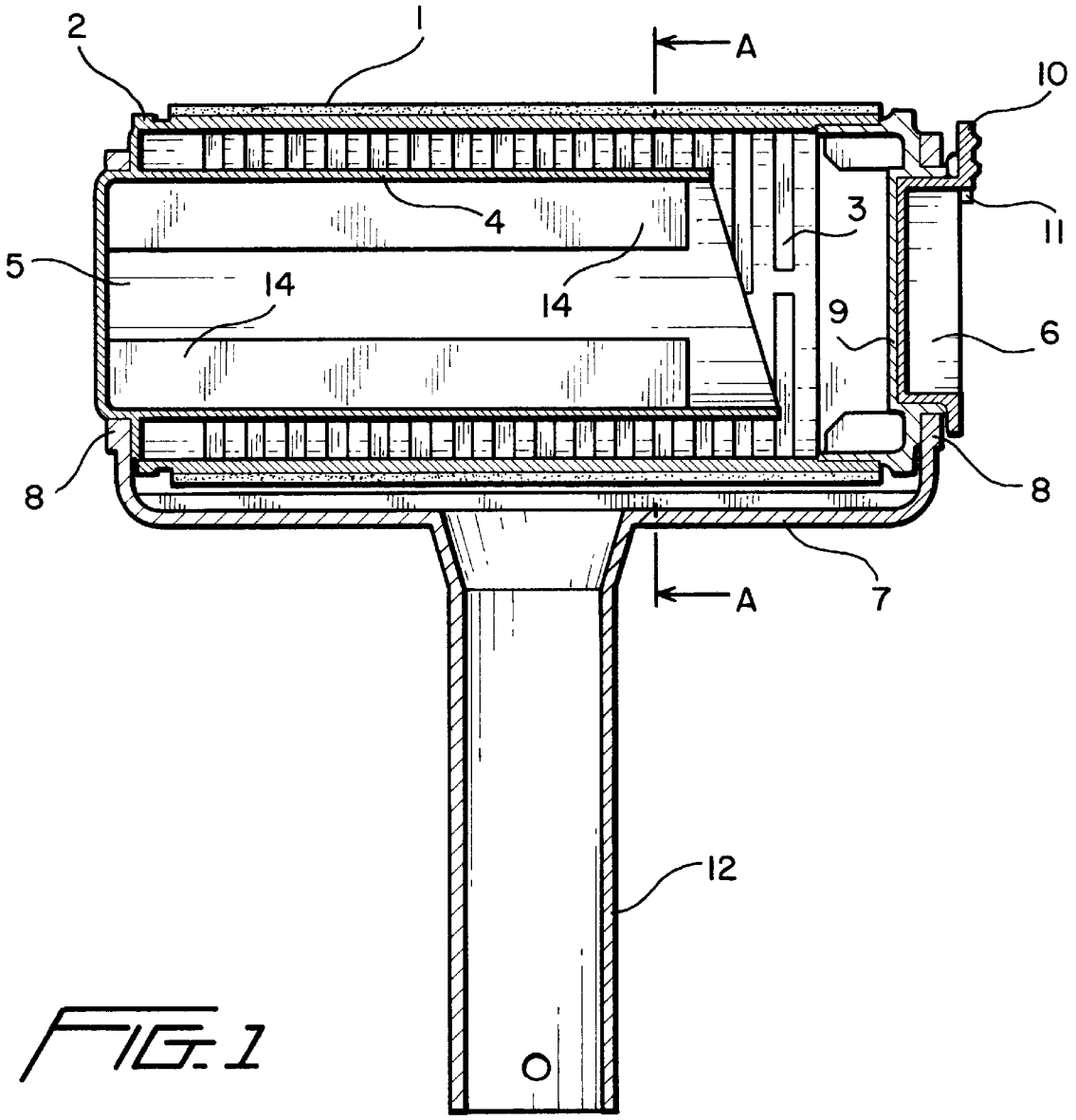
FIG. 1 is a front, cross sectional, elevational view of the present invention together with a handle frame.

FIG. 1 is a front, cross sectional, elevational view of the present invention together with handle frame. The present invention comprises an applicator 1 laid over the external surface of a roller 2 which is rotatably mounted at two ends walls 8 of a handle frame 7. The applicator is preferably made of absorbent material such as foam or sponge material. The interior of the roller 2 communicates with the external surface of the roller via a plurality of slits 3 on the roller. Disposed within the interior and preferably concentrically with the longitudinal axis (not shown) of the roller 2 is a reservoir 5 for receiving and storing paint through an opening 9. The reservoir 5 has an open ended wall 4 for retaining residue paint, and more importantly, preventing paint from flowing out of the roller when the roller is rested in a substantially vertical position. Although the wall 4 is shown to have a cylindrical shape in the figures, it can take on other shapes. Extended from the interior surface of the wall 4 are optionally two stirring blades 14 for mixing and distributing paint evenly in the reservoir 5 as the user rotates the roller 2.

Referring again to FIG. 1, the opening 9 of the roller 2 further has an extended end surface 11 for receiving snugly a removable cap 6. The cap includes a graspable flange 10 which allows the user to remove the cap for replenishing the reservoir or emptying the contents therein.

Figure 2:
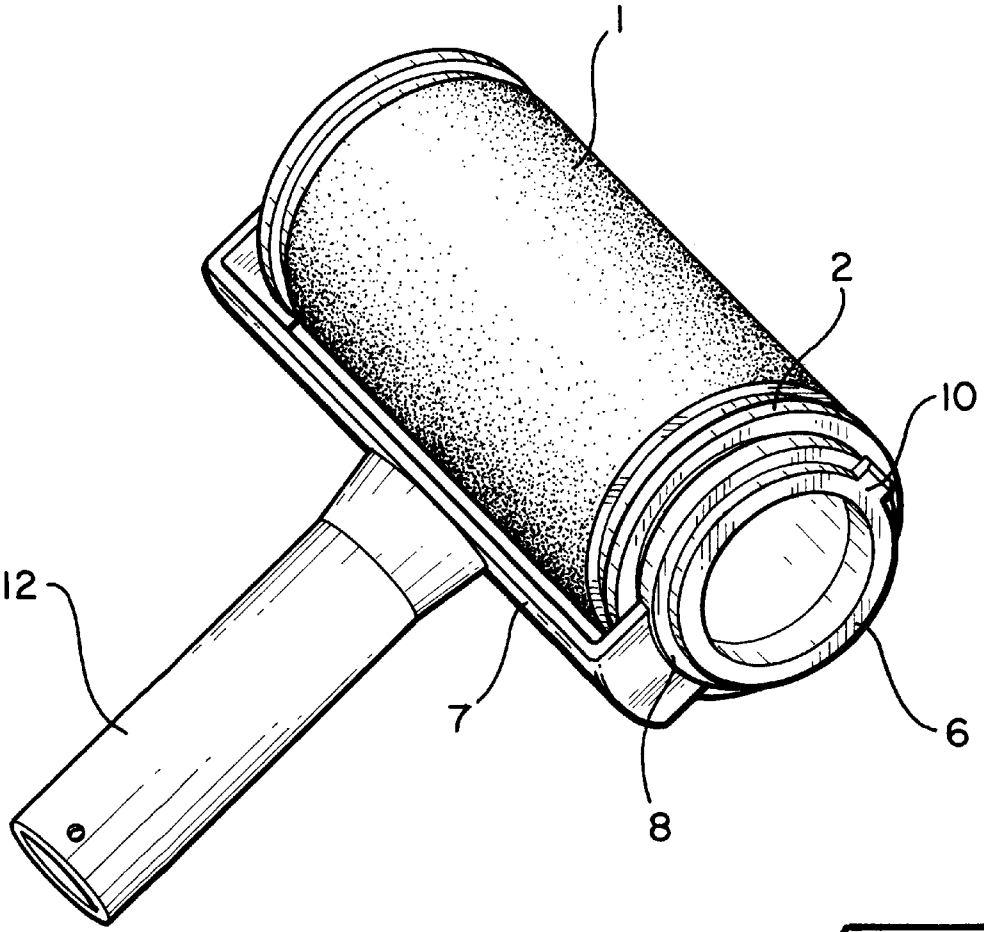
FIG. 2 is right side, perspective, and elevational view of the present invention as in FIG. 1.

FIG. 2 is right side, perspective, and elevational view of the present invention. Here, a better view of the cap 6 and its graspable flange 10 over the opening 9 (not shown) is illustrated together with the extended end surface 11 of the present invention. One side of the end wall 8 of the handle frame 7 is also shown. End walls 8 retain the end surfaces 11 and serve as support for the rotation of the roller 2 around the latter's longitudinal axis. End walls 8 are also designed to be removed easily from the end surfaces 11 of the roller 2. thus facilitating retrofitting or cleaning of the roller. A handle 12 is also shown extending from the handle frame 7; this handle allows the insertion of a pole so as to increase the effective length of the handle 12.

Figure 3:
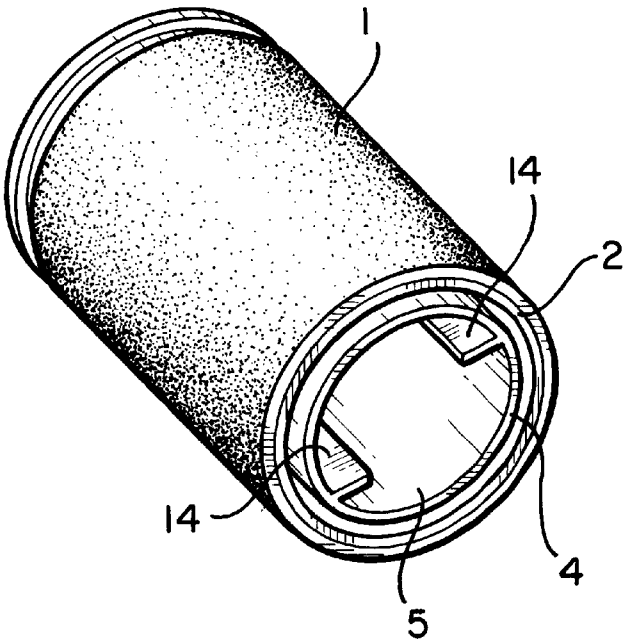
FIG. 3 is a right side, cut-away, and elevational view of the present invention according to section A—A in FIG. 1.

FIG. 3 is a right side, cut-away, and elevational view of the present invention according to section A—A in FIG. 1. The reservoir 5 of the present invention is shown along with the exposed interior of the roller 2. The open ended wall 4 and the stirring blades are also illustrated. The primary purpose of the wall 4 is to prevent residue paint from flowing out of the reservoir 5 when the roller is not in use. User would normally place it on the end portion 8 which is opposite the cap 6 on a flat surface such that the roller is in a vertical or quasi-vertical position. When the roller is in such a position, the most of the paint will be retained within the wall 4.

Figure 5:
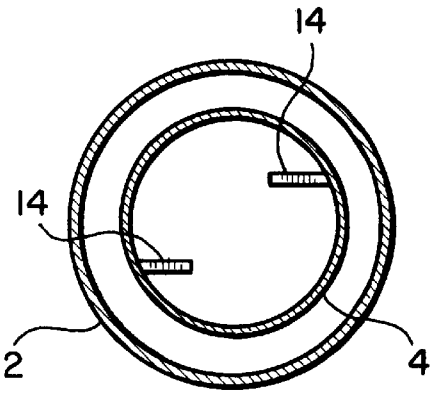
FIG. 5 is a cross-sectional view along cut C—C in FIG. 4.
Figure 4:
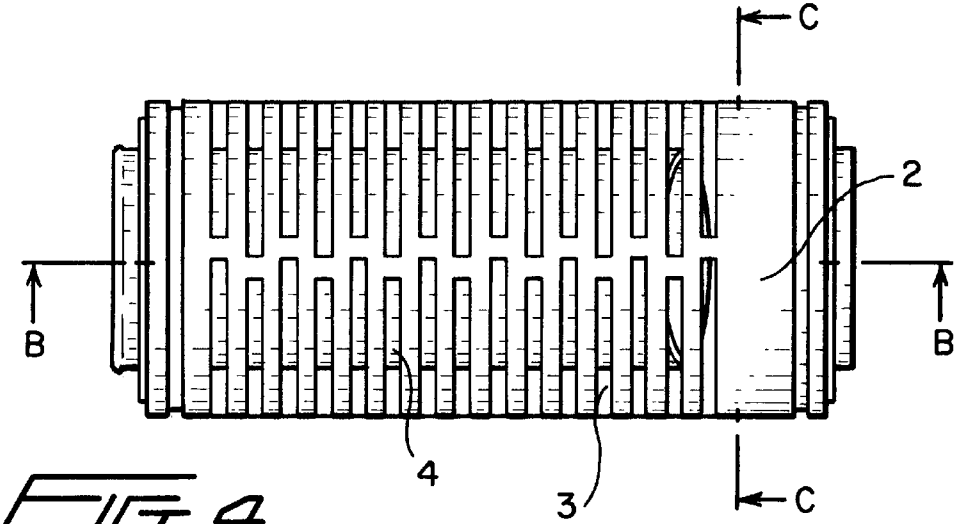
FIG. 4 is a top, plan view of the roller in isolation after the applicator is removed from its external surface.
Figure 8:
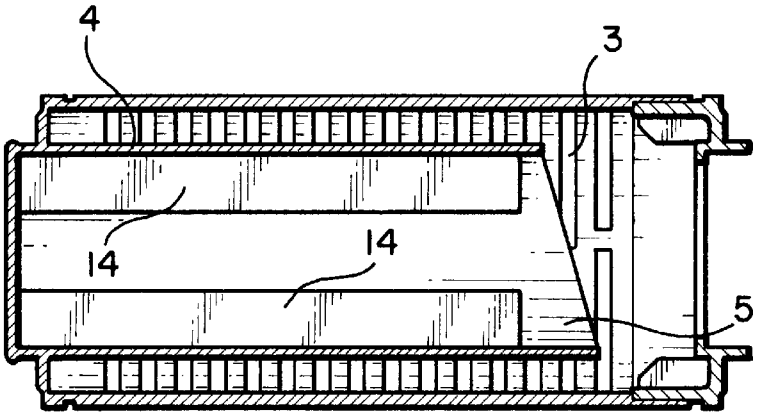

FIGS. 4, 5, and 6 are the plan, elevational and cross sectional views respectively of the roller 2 in isolation after the applicator 1 is removed and the handle frame detached therefrom. Here, a better view of the slits 3 disposed on the roller 2 are shown. Similarly, the open ended wall 4 and the stirring blades 14 are highlighted. The slits are cut in the rollers in a manner which spreads the paint evenly from the interior of the roller as the user rotates the roller. In the preferred embodiment of the present invention, at least two stirring blades are shown not only to mix the paint evenly in the reservoir 5, but also to provide better balance or feel for the user.

Figure 7:
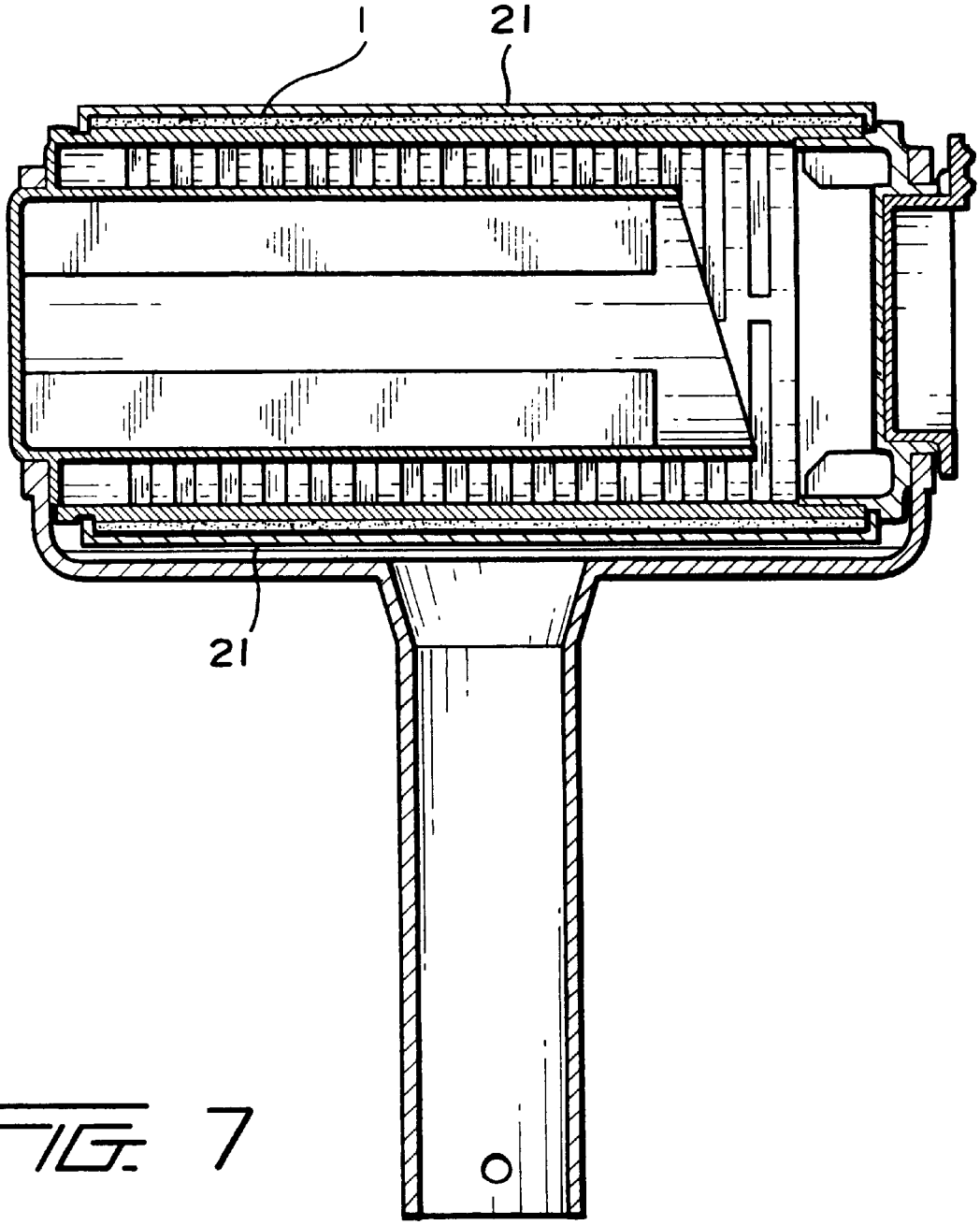
FIG. 7 is a front, cross-sectional, elevational view of an alternative embodiment of the present invention.

Experiment shows that the roller of the present invention together with a foam or sponge-like applicator is suitable for painting over large flat surfaces without replenishing the paint. Thus over a normal four wall interior of a room or enclosed space, the user needs to refill the roller of the present invention once for each wall. It is clear that the present invention reduces the amount of time one needs paint any surface. Over certain uneven surfaces and for certain types of paint, applicator made from foam or sponge-like material may leave micro-bubbles on the painted surfaces. It is shown (in FIG. 7) a felt material 21 wrapping the foam 1 or sponge-like applicator eliminates the micro-bubble problem.

While the present invention has been described particularly with reference to FIGS. 1 to 6 with emphasis on an apparatus for applying paint onto a target surface, it should be understood that the figures are for illustration only and should not be taken a limitation on the invention. In addition, it is clear that the apparatus of the present invention has utility in many applications where application of fluid onto surfaces is required. It is contemplated that many changes and modifications may be made by one of ordinary skill in the art without departing from the spirit and the scope of the invention as described.

I claim:

1. A painting tool including a handle frame comprising:

a roller including a cylindrical shell, said shell having a plurality of slits therethrough for communicating between the external surface of said roller and a volume within, said shell further having two end surfaces, one end surface having at least one opening for receiving paint; said slits running substantially normal to the longitudinal axis of said cylindrical shell and having a length of approximately a quarter of the circumference of said shell and spaced that the distance between two adjacent slits is substantially the width of said slit, said handle frame coupled to said cylindrical shell such that said shell can rotate along said longitudinal axis;

an internal reservoir disposed within the interior of said roller for receiving and dispensing paint from within said reservoir;

a wall disposed within said reservoir for retaining residue paint when the roller is rested on an upright position, said wall having at least one opening end facing said end surface with opening for receiving residue paint; and an applicator laying over the external surface of said roller for applying paint over a target surface, whereby paint from the internal reservoir is dispensed evenly and automatically over said plurality of slits and said applicator onto the target surface.

2. The painting tool as in claim 1 wherein said roller is detachable from said handle frame.

3. The painting tool as in claim 1 wherein said end surface with opening is adapted for receiving a cap therethrough.

4. The painting tool as in claim 1 wherein said wall has a cylindrical shape.

5. The painting tool as in claim 1 wherein said applicator comprises of absorbent material.

6. The painting tool as in claim 5 wherein said absorbent material is made of foam.

7. The painting tool as in claim 1 wherein said applicator comprises of a felt material laid over an absorbent material.

8. The painting tool as in claims 7 wherein said absorbent material is made of foam.

9. The painting tool as in claim 1 wherein said internal reservoir has at least one stirring blade disposed on the interior of said wall for mixing evenly paint therein.

10. A painting tool comprising:

a cylindrical roller having a plurality of slits therethrough for communicating between the external surface of said cylindrical roller and a volume within, said roller further having two end walls, one end wall having at least one opening for receiving paint; said slits running substantially normal to the longitudinal axis of said cylindrical roller and having a length of approximately a quarter of the circumference of said shell and spaced such that the distance between two adjacent slits is substantially the width of said slit;

a handle frame rotatably coupled to said roller such that said cylindrical roller can rotate along said longitudinal axis;

a cap to cover said opening; and an applicator laying over the external surface of said cylindrical roller for applying paint over a target surface, whereby paint from the interior of said cylindrical roller is dispensed evenly and automatically over said plurality of slits and said applicator onto the target surface.

11. The painting tool as in claim 10 wherein said roller is detachable from said handle frame.

12. The painting tool as in claim 10 wherein said applicator comprises an absorbent material.

13. The painting tool as in claim 10 wherein said applicator comprises a felt material laid over an absorbent material.

14. The painting tool as in claim 10 wherein said applicator comprises an absorbent material made of foam.

15. The painting tool as in claim 10 wherein said applicator comprises a felt material laid over an absorbent material, said absorbent material being made of foam.

* * * * *